US010345059B2

(12) United States Patent
Gibbens et al.

(10) Patent No.: US 10,345,059 B2
(45) Date of Patent: Jul. 9, 2019

(54) SIDE CHARGER FOR A WEAPON

(71) Applicants: Kevin W. Gibbens, Mesa, AZ (US); David W. Gibbens, Mesa, AZ (US)

(72) Inventors: Kevin W. Gibbens, Mesa, AZ (US); David W. Gibbens, Mesa, AZ (US)

(73) Assignee: Gibbens Engineering Group, LLC, Mesa, AZ (US)

( * ) Notice: Subject to any disclaimer, the term of this patent is extended or adjusted under 35 U.S.C. 154(b) by 0 days.

(21) Appl. No.: 15/872,382

(22) Filed: Jan. 16, 2018

(65) Prior Publication Data

US 2018/0202732 A1 Jul. 19, 2018

Related U.S. Application Data

(60) Provisional application No. 62/446,559, filed on Jan. 16, 2017.

(51) Int. Cl.
*F41A 3/72* (2006.01)
*F41A 3/66* (2006.01)

(52) U.S. Cl.
CPC . *F41A 3/72* (2013.01); *F41A 3/66* (2013.01)

(58) Field of Classification Search
CPC ..... F41A 3/72
USPC ..... 89/1.4
See application file for complete search history.

(56) References Cited

U.S. PATENT DOCUMENTS

| | | | | | |
|---|---|---|---|---|---|
| 1,858,498 | A * | 5/1932 | Hatcher | F41A 7/02 | 89/1.4 |
| 2,181,131 | A * | 11/1939 | Johnson, Jr. | F41A 3/72 | 42/16 |
| 4,553,469 | A * | 11/1985 | Atchisson | F41A 3/46 | 42/25 |
| 6,019,024 | A * | 2/2000 | Robinson | F41A 3/72 | 89/1.42 |
| 7,849,777 | B1 * | 12/2010 | Zedrosser | F41A 3/26 | 42/16 |
| 8,156,854 | B2 * | 4/2012 | Brown | F41A 3/72 | 89/1.4 |
| 8,342,075 | B2 * | 1/2013 | Gomez | F41A 5/18 | 89/191.01 |
| 8,899,138 | B2 * | 12/2014 | Brown | F41A 3/72 | 89/1.4 |
| 10,006,726 | B1 * | 6/2018 | Oglesby | F41A 3/72 | |
| 10,088,256 | B1 * | 10/2018 | Oglesby | F41A 3/20 | |
| 2011/0061523 | A1 * | 3/2011 | Webb | F41A 3/42 | 89/128 |

(Continued)

*Primary Examiner* — Reginald S Tillman, Jr.
(74) *Attorney, Agent, or Firm* — Schmeiser, Olsen & Watts LLP

(57) ABSTRACT

An upper receiver assembly for an AR style rifle is provided. The upper receiver assembly includes an upper receiver body with a channel formed in a side of the body. Further, the assembly includes a bolt carrier operatively coupled within the upper receiver body. A bolt is coupled within the bolt carrier, wherein a cam pin is coupled to the bolt and extends through an aperture of the bolt carrier. The assembly also includes a side charger having a charging handle that extends through the channel of the upper receiver body. The side charger also includes a bolt carrier engagement member. The bolt carrier engagement member engages the bolt carrier and moves the cam pin in response to pulling the charging handle toward the butt stock of the weapon. This results in charging the rifle.

3 Claims, 18 Drawing Sheets

(56) References Cited

U.S. PATENT DOCUMENTS

| | | | | |
|---|---|---|---|---|
| 2011/0083551 | A1* | 4/2011 | Sirochman | F41A 3/72<br>89/191.01 |
| 2013/0174457 | A1* | 7/2013 | Gangl | F41A 3/18<br>42/16 |
| 2015/0010747 | A1* | 1/2015 | Hotta | B32B 5/18<br>428/319.7 |
| 2016/0033219 | A1* | 2/2016 | Meier | F41A 3/66<br>89/191.01 |
| 2016/0061542 | A1* | 3/2016 | Daley, Jr. | F41A 3/72<br>89/1.4 |
| 2017/0016689 | A1* | 1/2017 | Bero | F41A 3/66 |
| 2017/0122685 | A1* | 5/2017 | Kolev | F41A 3/12 |
| 2017/0176119 | A1* | 6/2017 | Cross | F41A 17/38 |

* cited by examiner

SIDE CHARGER FOR A WEAPON

CROSS REFERENCE TO RELATED APPLICATION[S]

This application claims priority to U.S. Provisional Patent Application entitled "SIDE CHARGER FOR A WEAPON," Ser. No. 62/446,559, filed Jan. 16, 2017, the disclosure of which is hereby incorporated entirely herein by reference.

BACKGROUND OF THE INVENTION

Technical Field

This invention relates generally to a charging handle for an upper receiver assembly for a weapon and more particularly to a side charger for an upper receiver assembly for rifle such as an AR style rifle or similar weapon.

State of the Art

Currently, weapons are used for a variety of reasons from recreational use, to hunting and for tactical use by law enforcement and the like. In particular, rifles are a commonly owned weapon and used for various reasons. A rifle, such as an AR-15 or an AR-10, has the capability for use with multiple calibers of ammunition. In order to charge the weapon, conventional charging assemblies are located on the top of the weapon toward the rear of the upper receiver. This location requires movement from a typical shooting orientation of the weapon in order to charge it.

Accordingly, there is a need for an upper receiver that allows for a different location for a charging assembly.

SUMMARY OF THE INVENTION

The present invention relates to an upper receiver with a side charging handle for an AR style rifle or similar weapon.

In embodiments, an upper receiver assembly for an AR style rifle comprises an upper receiver body with a channel formed in a side of the body; a bolt carrier operatively coupled within the upper receiver body; a bolt coupled within the bolt carrier, wherein a cam pin is coupled to the bolt and extends through an aperture of the bolt carrier; and a side charger having a charging handle that extends through the channel of the upper receiver body and a bolt carrier engagement member, wherein the bolt carrier engagement member engages the bolt carrier and moves the bolt carrier in response to pulling the charging handle toward the butt stock of the weapon.

In some embodiments, the upper receiver assembly comprises a hinged member moveable between an open and a closed position. The hinged member is moveable to the open position when the upper receiver is disengaged from a lower receiver. Additionally, the hinged member is retained in the closed position when the upper receiver is engaged with a lower receiver.

In some embodiments, the upper receiver assembly comprises a raised section in the cam pin, wherein the raised section provides better engagement with the camp pin engagement member.

In some embodiments, the upper receiver assembly comprises a gas port aperture, wherein the gas port aperture and a gas port set screw, wherein a gas tube of the rifle extends into the upper receiver assembly through the set screw to engage a gas key of the bolt carrier.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to an upper receiver with a side charging handle for an AR style rifle or similar weapon.

Figure 1:
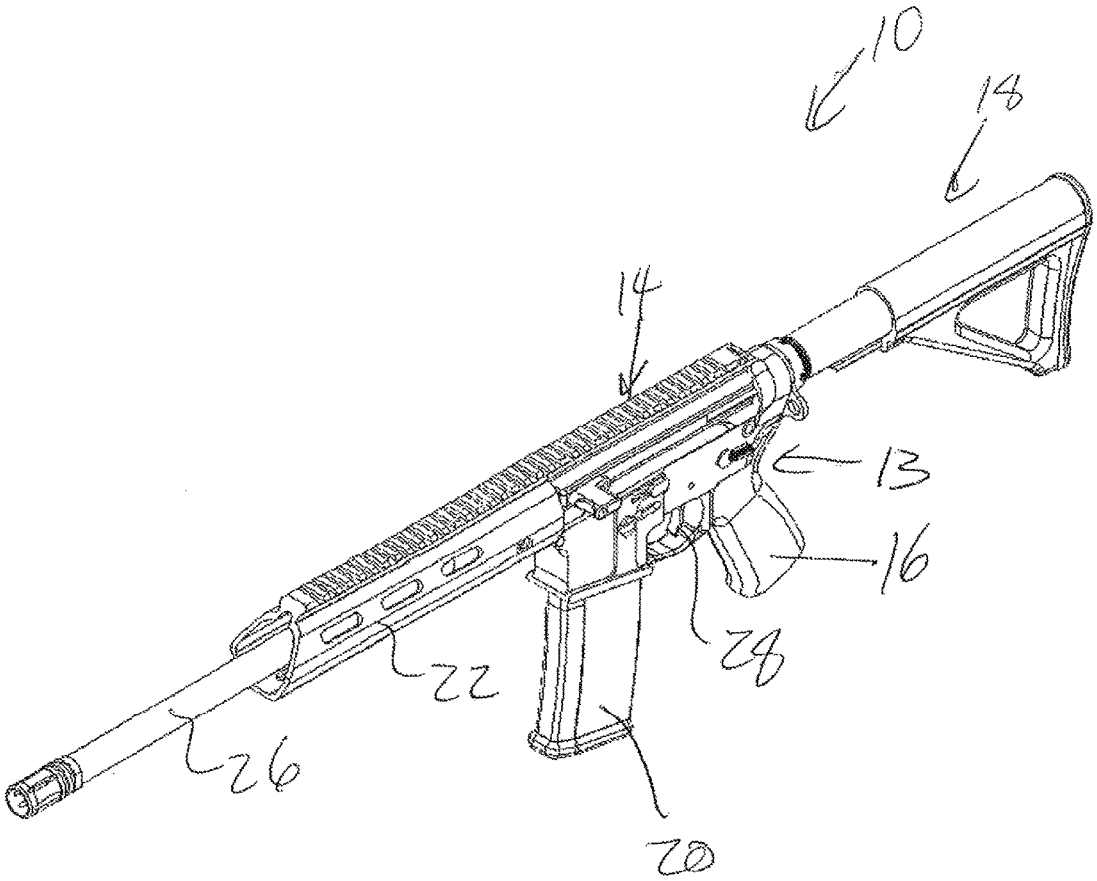
FIG. 1 is a perspective view of a rifle with an upper receiver operatively coupled thereto.
Figure 2:
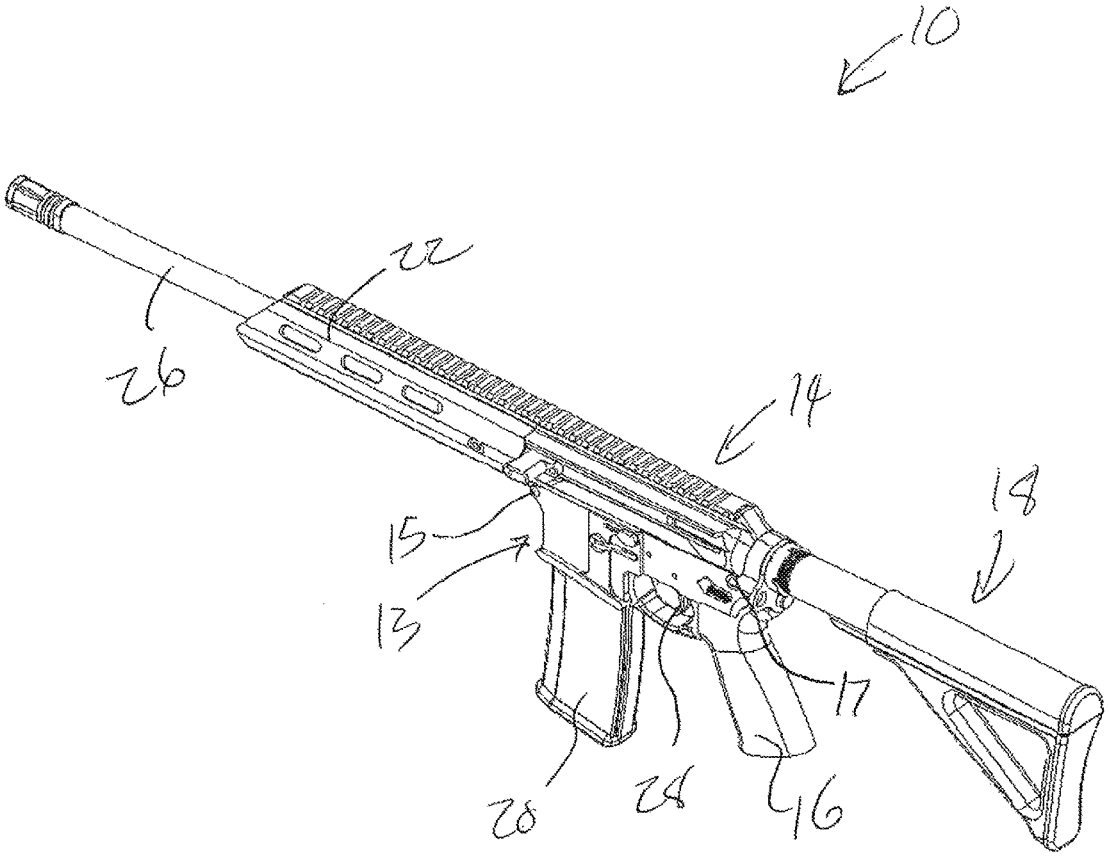
FIG. 2 is another perspective view of a rifle with an upper receiver operatively coupled thereto.
Figure 3:
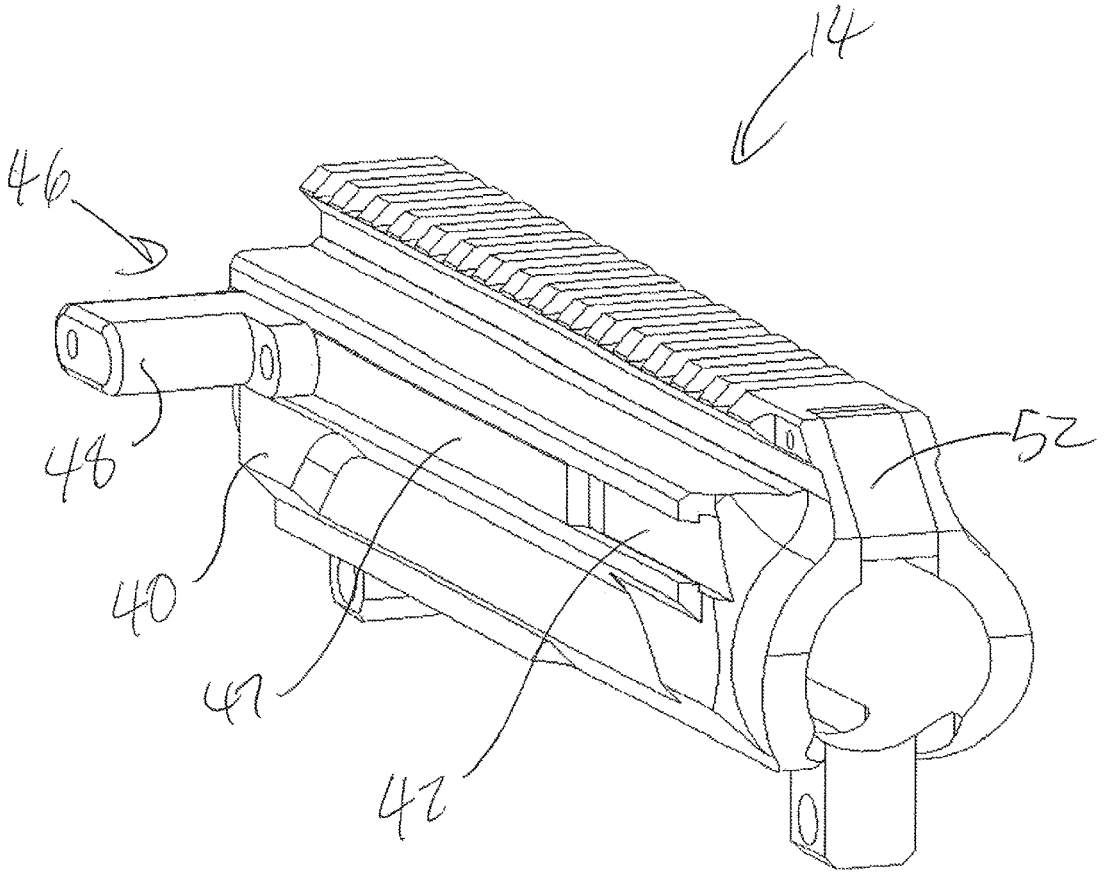
FIG. 3 is a perspective view of an upper receiver assembly.
Figure 4:
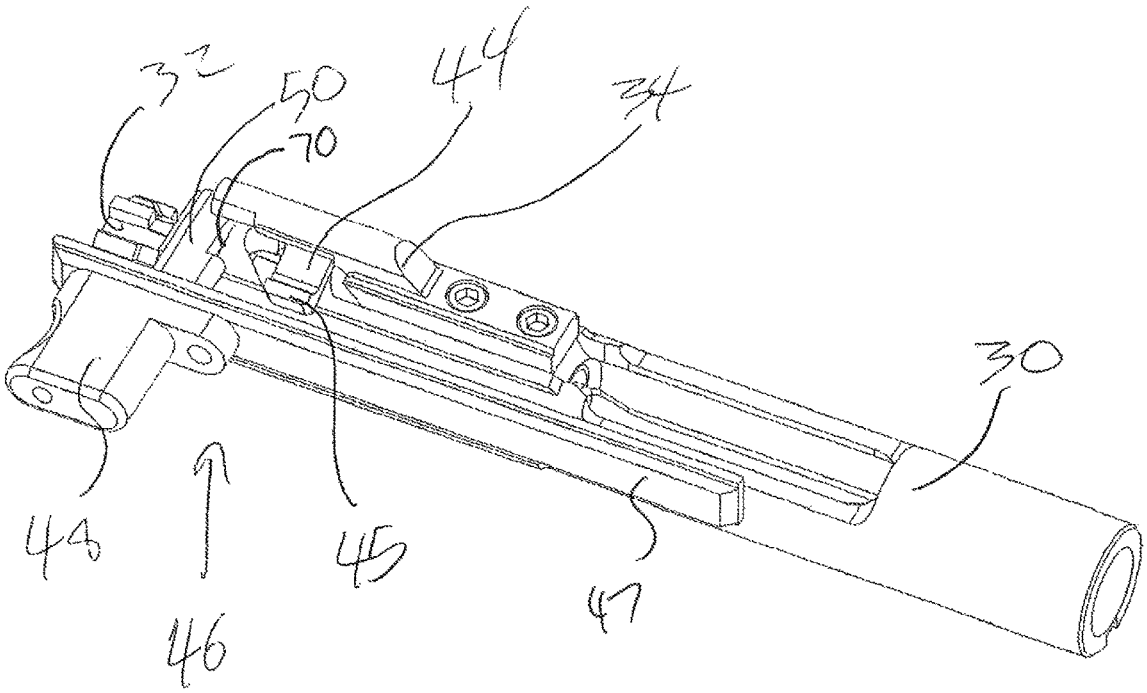
FIG. 4 is a perspective view of a bolt with bolt carrier and a side charger.
Figure 5:
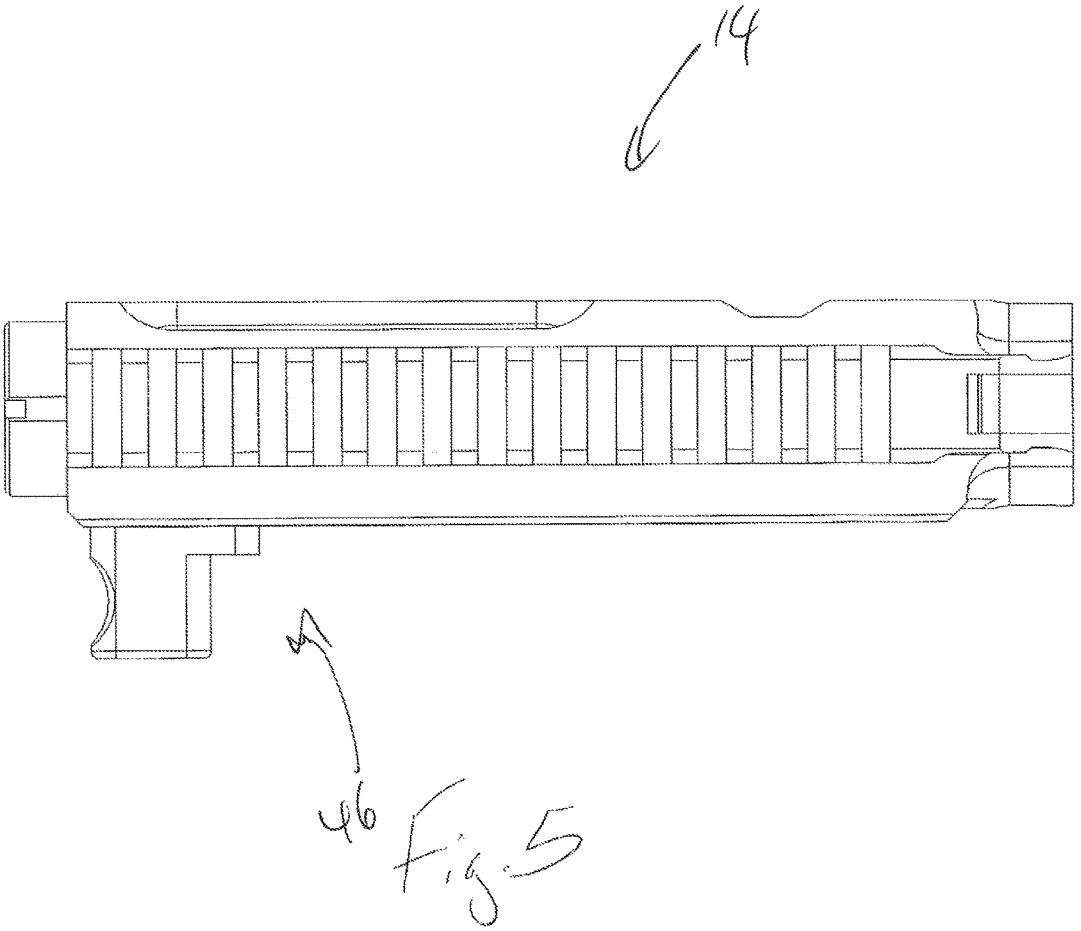
FIG. 5 is a top view of an upper receiver assembly.
Figure 6:
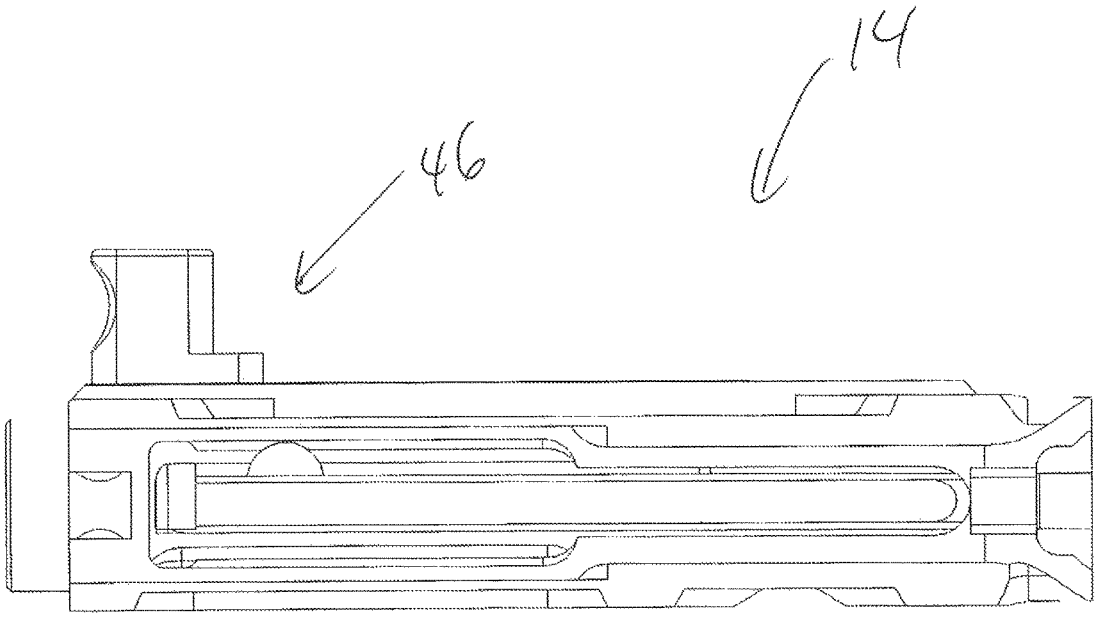
FIG. 6 is a bottom view of an upper receiver assembly.
Figure 7:
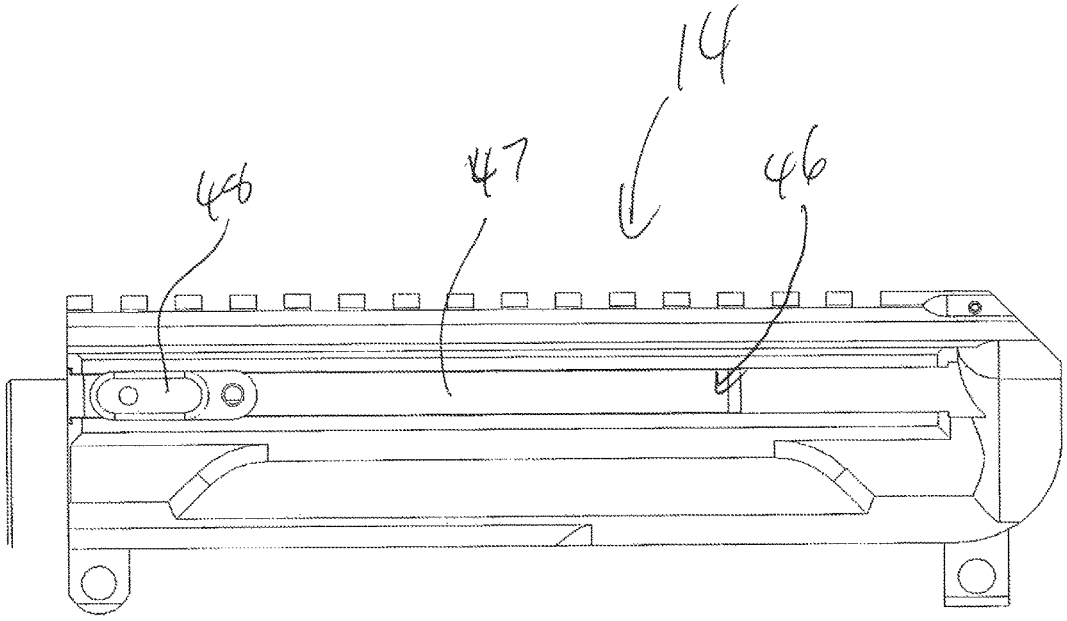
FIG. 7 is a left side view of an upper receiver assembly.
Figure 8:
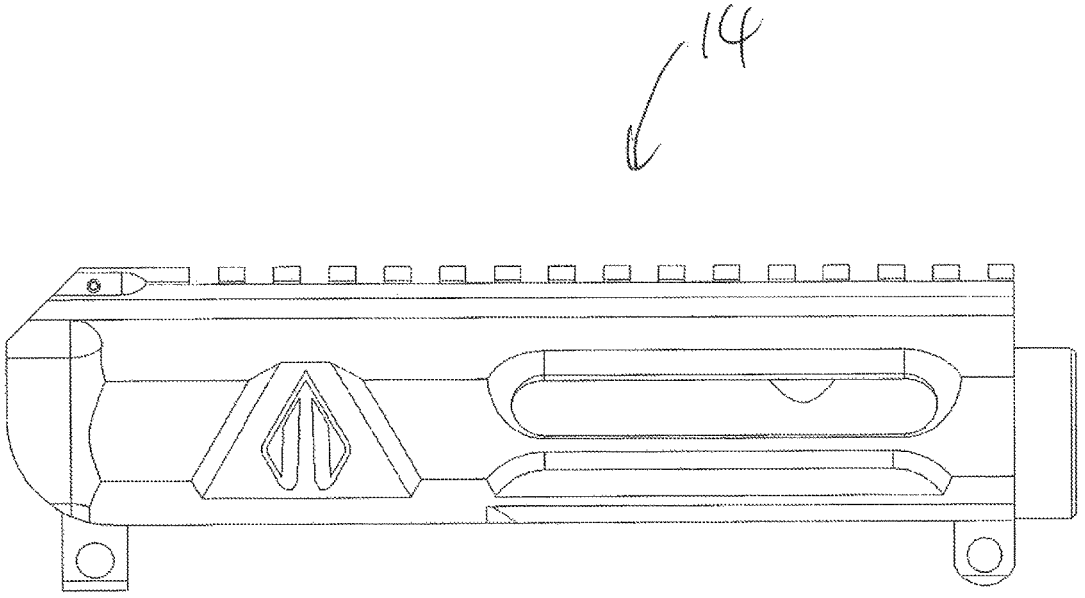
FIG. 8 is a right side view of an upper receiver assembly.
Figure 9:
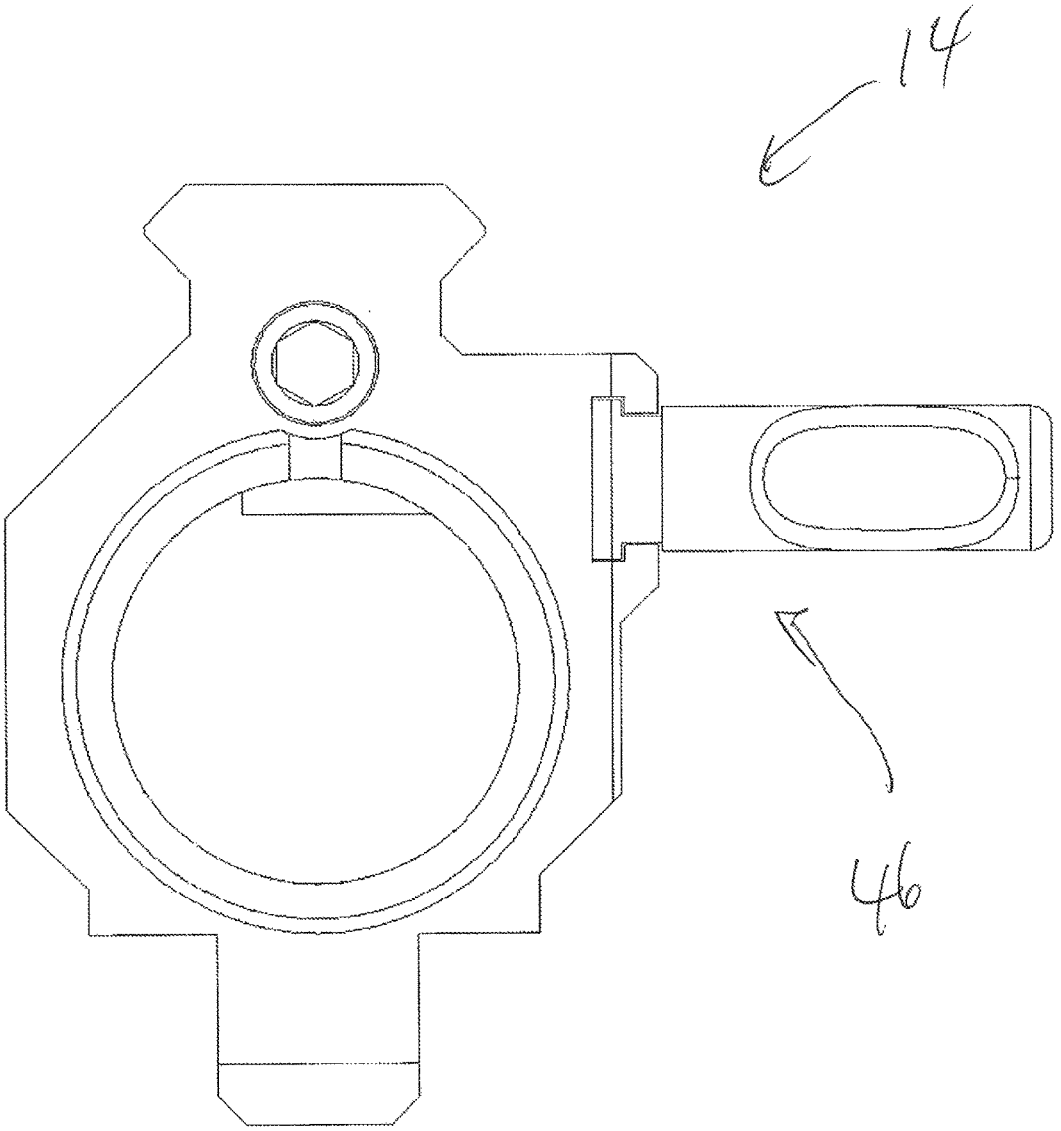
FIG. 9 is a front view of an upper receiver assembly.
Figure 10:
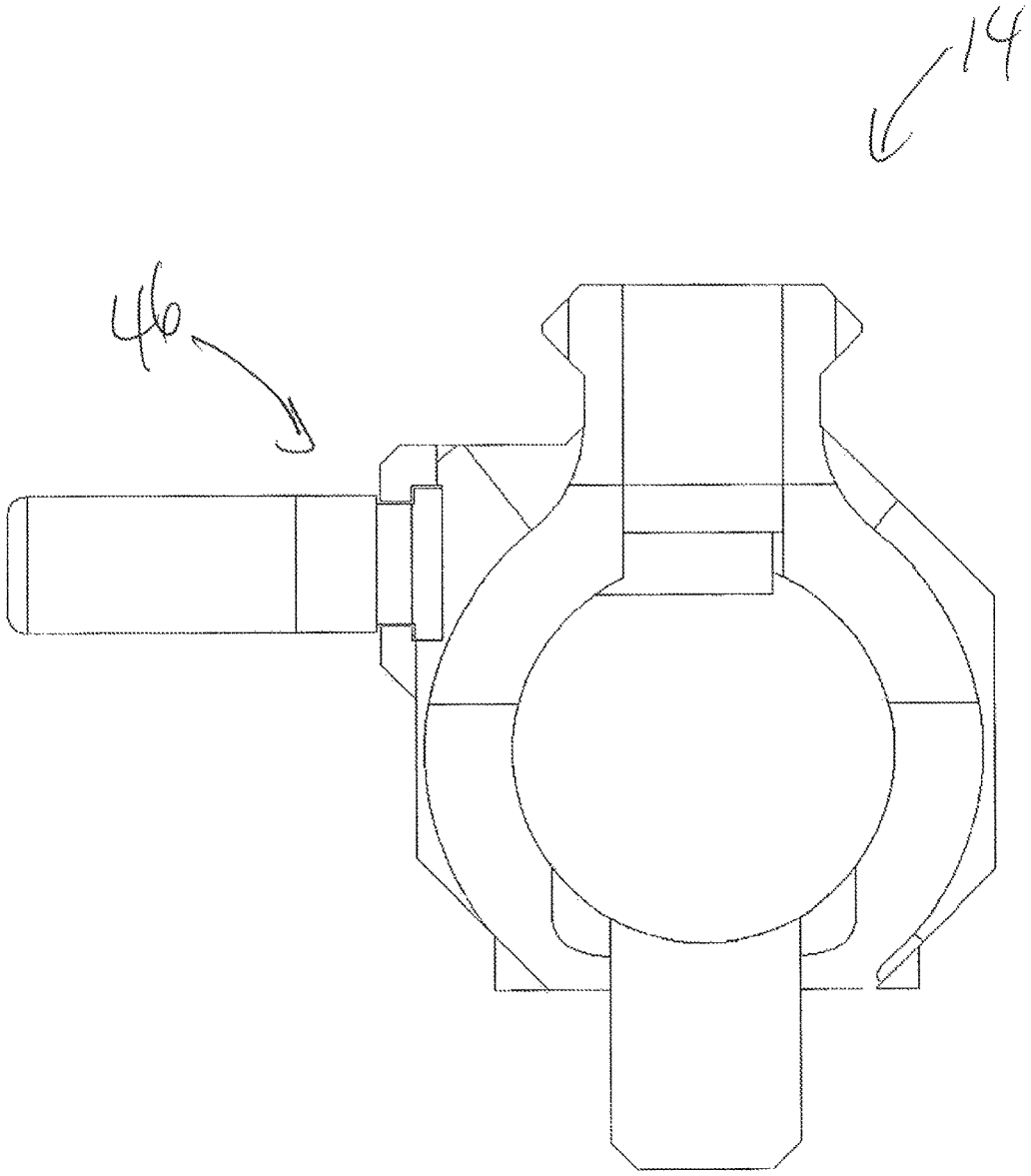
FIG. 10 rear view of an upper receiver assembly.
Figure 11:
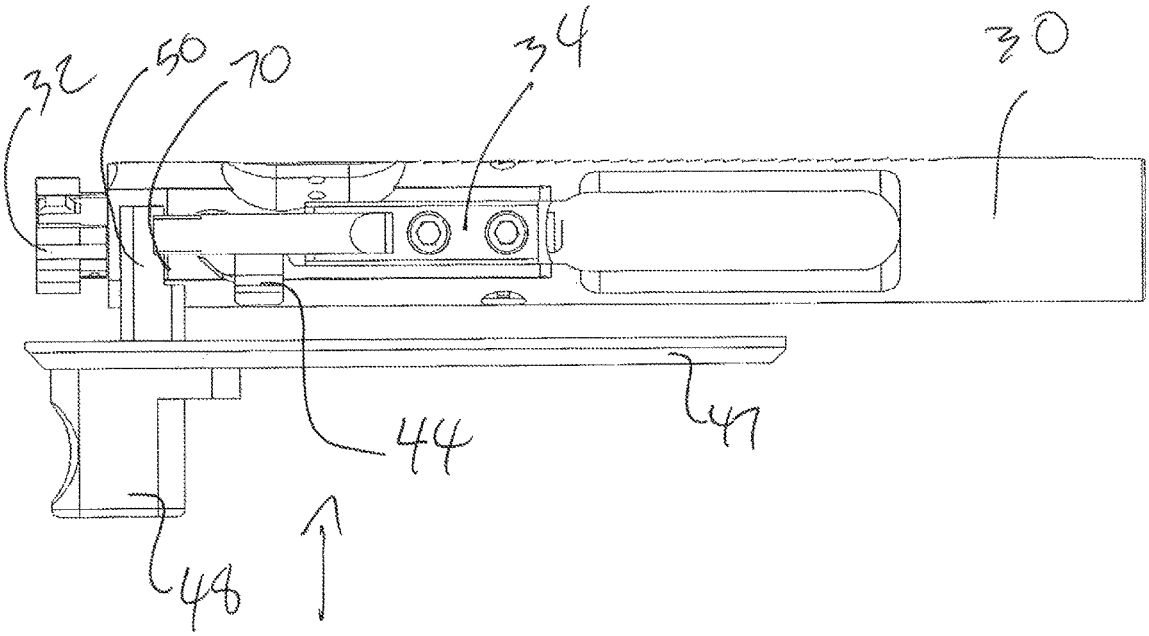
FIG. 11 is a top view of a bolt with bolt carrier and a side charger.
Figure 12:
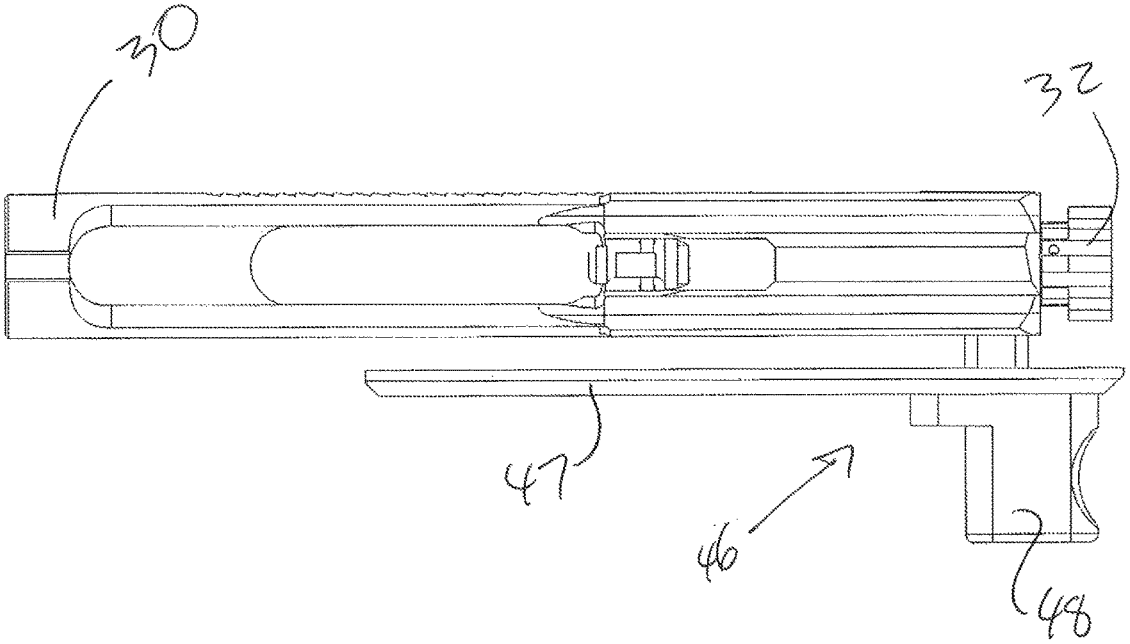
FIG. 12 is a bottom view of a bolt with bolt carrier and a side charger.
Figure 13:
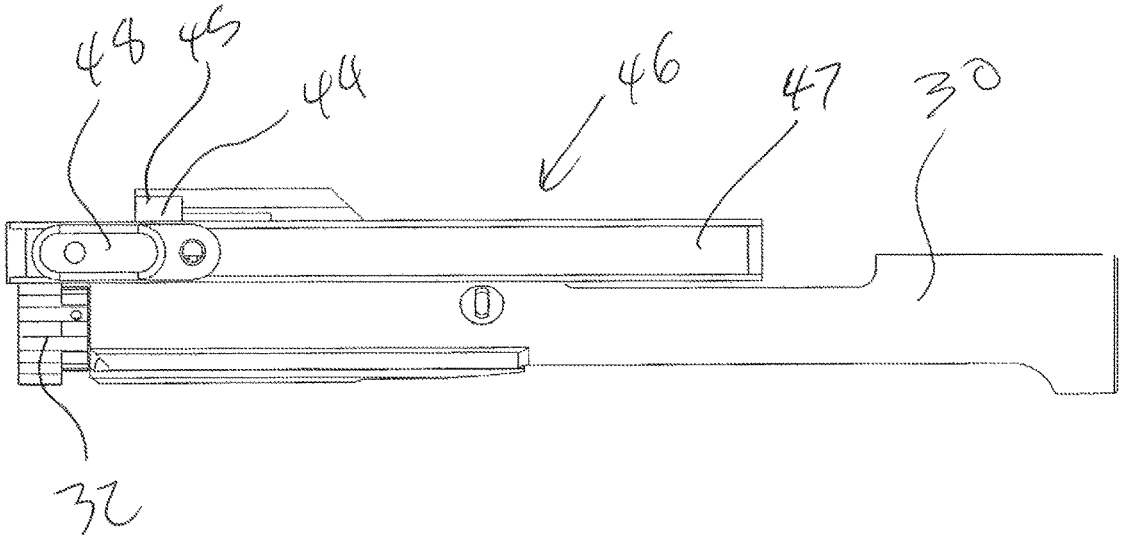
FIG. 13 is a left side view of a bolt with bolt carrier and a side charger.
Figure 14:
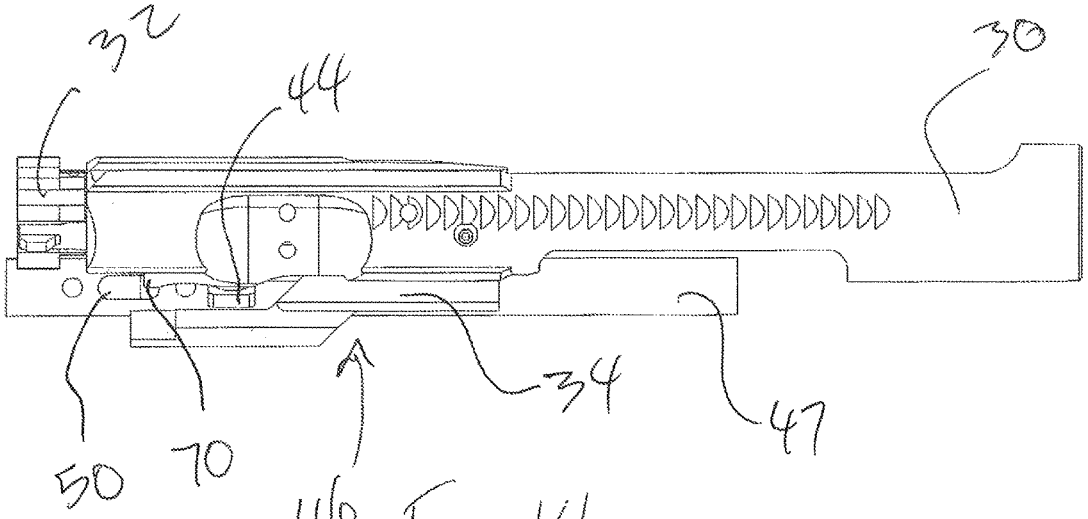
FIG. 14 is a right side view of a bolt with bolt carrier and a side charger.
Figure 15:
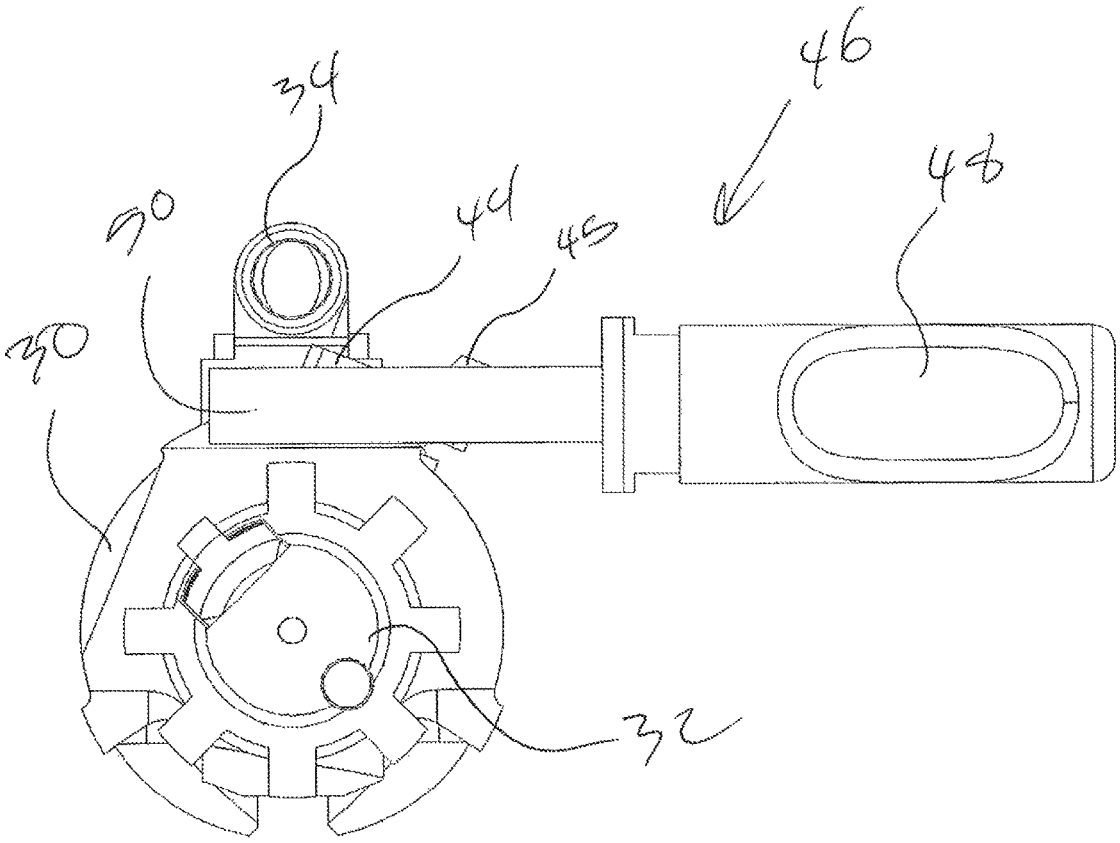
FIG. 15 is a front view of a bolt with bolt carrier and a side charger.
Figure 16:
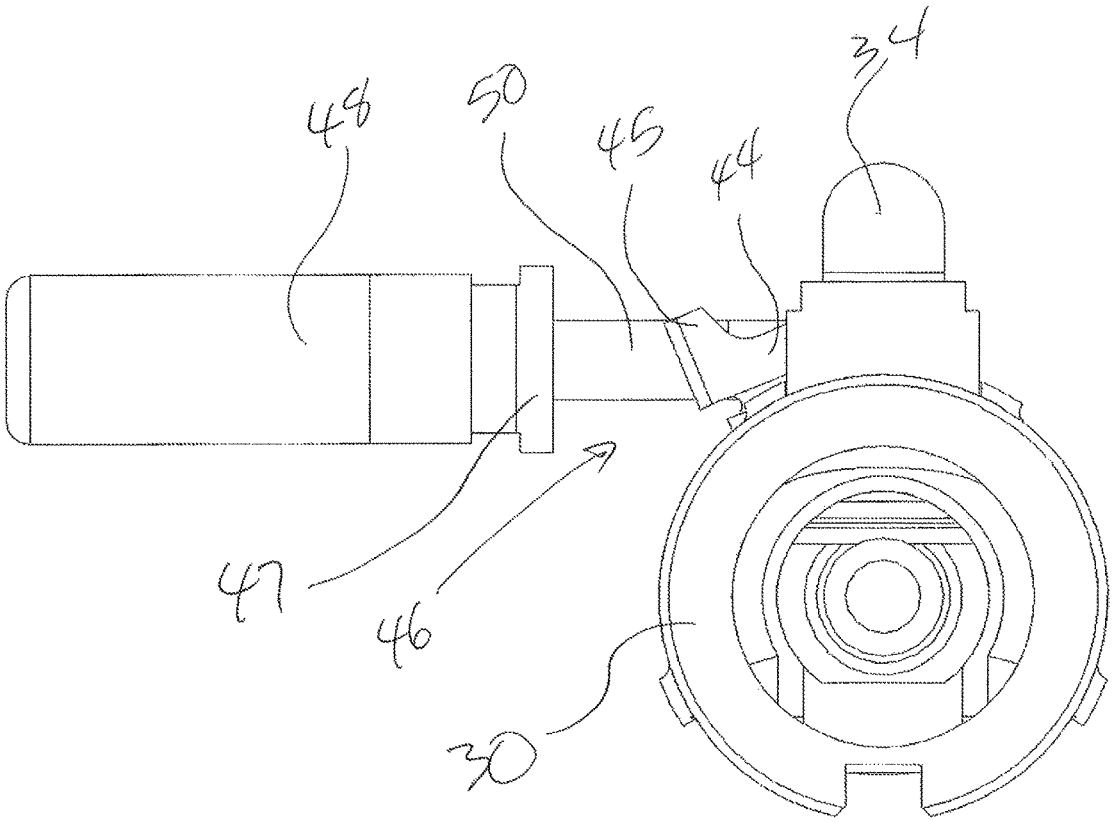
FIG. 16 is a rear view of a bolt with bolt carrier and a side charger.

Referring to the drawings, FIGS. 1 and 2 depict a rifle 10 with the conversion kit 12 coupled there to. The rifle 10 comprises a lower receiver 13, wherein the lower receiver is coupled to a pistol grip 16, a butt stock 18, a trigger 28 a magazine 20 and all other components that are conventionally part of an AR style rifle. The rifle 10 further comprises an upper receiver 14, wherein the upper receiver is coupled to a barrel 26, and a hand guard 22. A bolt carrier and bolt are operationally coupled within the upper receiver 14. According to embodiments of the present invention, the lower receiver 13 is operatively coupled with the upper receiver 14 by use of two pins, wherein the two pins comprise a front pin 15 and a rear pin 17. The coupling of the lower receiver 13 to the upper receiver 14 results in a mechanical coupling of all of the interior operational components located within the lower receiver and the bolt carrier 30 of the upper receiver 14. All of the components are operationally assembled together.

It will be understood that the lower receiver 13, the butt stock 18, the trigger 28, the hand guard 22, pistol grip 16, and the barrel 26 and all other external and internal components not specifically discussed are assembled in an AR style rifle, and are part of the rifle 10. The upper receiver assembly 14 of the rifle 10 includes other conventional parts that are not specifically discussed in this disclosure and therefor in at least this way, the upper receiver assembly 14 may fully replace a conventional upper receiver assembly of an AR style.

With additional reference to FIGS. 3-16, the upper receiver assembly 14 includes an upper receiver body 40 with a channel 42 formed in a side of the body 40. A bolt carrier 30 with a bolt 32 is operatively coupled within the upper receiver body 40. The upper receiver assembly 14 comprises a cam pin 44, wherein the cam pin 44 engages the bolt 32 and extends through an aperture of the bolt carrier 30. The upper receiver assembly 14 also comprises a side charger 46 having a charging handle 48 that extends through the channel 42 of the upper receiver body 40. The side charger 46 also includes a bolt carrier engagement member 50, wherein the bolt carrier engagement member 50 engages protrusion 70 located in front of the cam pin 44 and moves the bolt carrier 30 in response to pulling the charging handle 48 toward the butt stock 18 of the rifle 10. The side charger 46 comprises a sliding connector 47, wherein the charging handle 48 and the bolt carrier engagement member 50 are coupled to the sliding connector 47. The sliding connector 47 engages the channel 42 of the upper receiver body 40 and allows for the side charger 46 to slide toward the butt stock 18 of the rifle 10 by applying force to the charging handle 48 in a direction toward the butt stock 18.

The upper receiver assembly 14 may also comprise a hinged member 52 moveable between an open and a closed position. The hinged member 52 is moveable to the open position when the upper receiver 14 is disengaged from a lower receiver 13. Further, the hinged member 14 is retained in the closed position when the upper receiver 14 is engaged with a lower receiver 13.

The upper receiver assembly 14 also comprises a raised section 45 in the cam pin 44, wherein the raised section 45 allows for the cam pin 44 to operate correctly within the upper receiver body 40. The upper receiver body 40 has been modified from conventional upper receiver bodies to account for the side charger 46.

The upper receiver assembly 14 comprises a gas port aperture 60. The gas port aperture 60 operates to allow a gas port to extend into the upper receiver assembly 14. In embodiments, the gas port aperture 60 includes a gas port set screw 62 mounted within the gas port aperture 60. A gas tube of the rifle 10 extends into the upper receiver assembly 14 through the set screw 62 to engage a gas key 34 of the bolt carrier 30.

Figure 17:
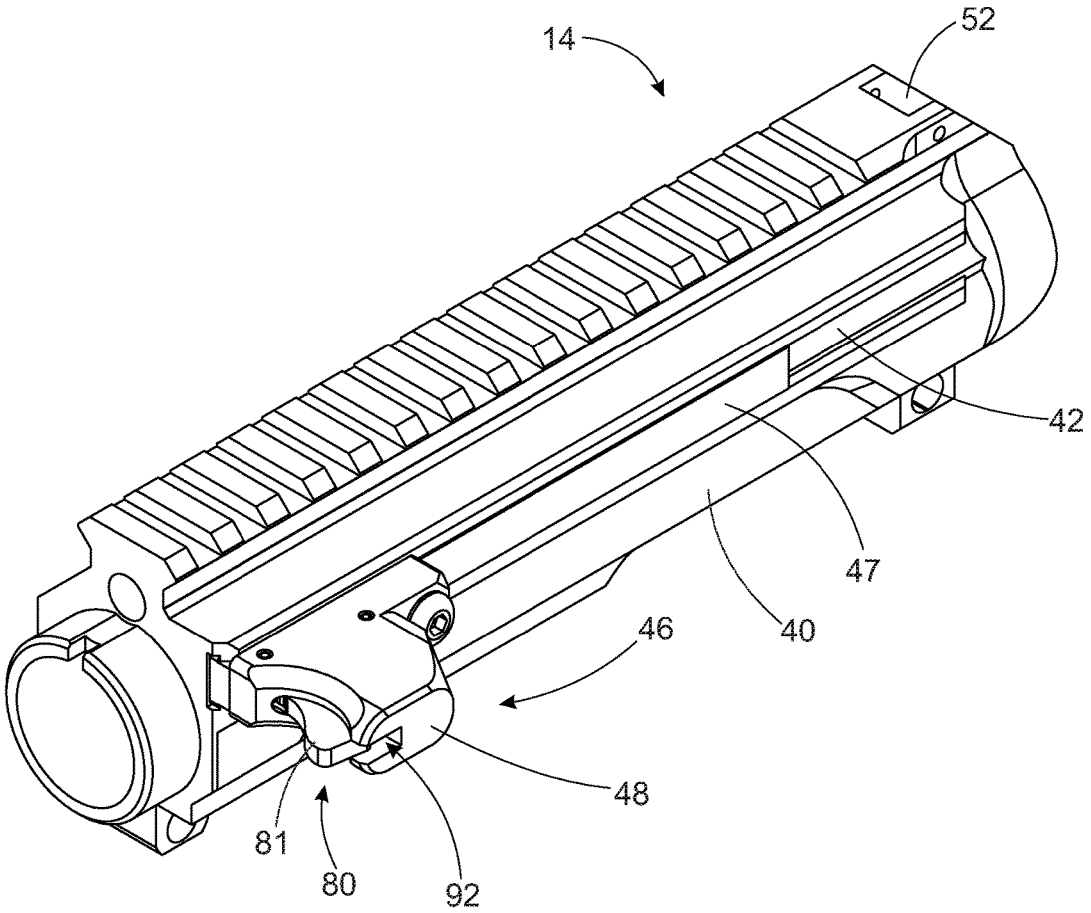
FIG. 17 is a perspective view of an upper receiver assembly with a side charger.
Figure 18:
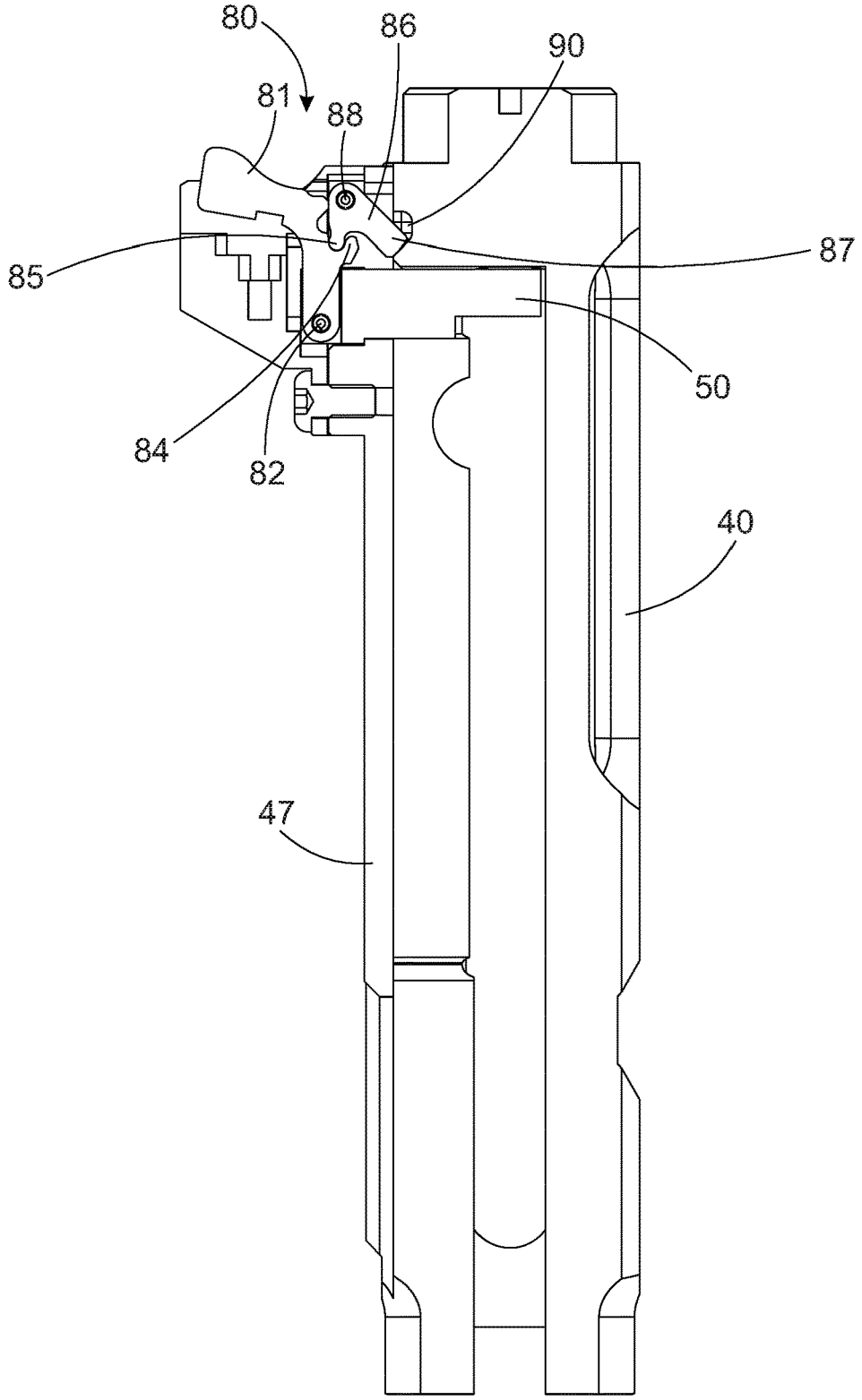
FIG. 18 is a section view of an upper receiver assembly with a side charger.

Referring again to the drawings, another embodiment is shown in FIGS. 17-18, the upper receiver assembly 14 includes the same elements as described with regard to FIGS. 3-16, namely an upper receiver body 40 with a channel 42 formed in a side of the body 40. The upper receiver assembly 14 also comprises a side charger 46 having a charging handle 48 that extends through the channel 42 of the upper receiver body 40. The side charger 46 also includes a bolt carrier engagement member 50, wherein the bolt carrier engagement member 50 engages protrusion 70 located in front of the cam pin 44 and moves the bolt carrier 30 in response to pulling the charging handle 48 toward the butt stock 18 of the rifle 10, in a similar manner as described with regard to FIGS. 3-16. The side charger 46 comprises a sliding connector 47, wherein the charging handle 48 and the bolt carrier engagement member 50 are coupled to the sliding connector 47. The sliding connector 47 engages the channel 42 of the upper receiver body 40 and allows for the side charger 46 to slide toward the butt stock 18 of the rifle 10 by applying force to the charging handle 48 in a direction toward the butt stock 18.

The side charger 46 may include a side charging handle 48 having a slot 92. The slot 92 comprises a locking device 80 comprises an actuating member 81 rotatable about a pin 82, the actuating device 81 comprising a hook member 84. The locking device 80 further comprises a locking member 86 rotatable about a pin 88, the locking member 86 comprising a hook member 85 and an engagement member 87. The hook member 85 of the locking member 86 operatively engages the hook member 84 of the actuating device 81. Operatively engaging the hook member 84 of the actuating member 81 and the hook member 85 of the locking member 86 includes rotating of the locking member 81 by pulling on the actuating member 81 toward the butt stock 18 of the rifle. Pulling on the actuating member 81 rotates the actuating member 81 about the pin 82 to move hook member 84. Movement of hook member 84 engages hook member 85 of the locking member 86 and rotates the locking member 86 about pin 88. The rotation of the locking member 86 about pin 88 moves engagement member 87 out of a recess 90 in the upper receiver body 40, thereby allowing the side charging handle 48 to be pulled and the side charger 46 to operate as described above. When the side charger 46 is slid forward, the actuating member 81 and the locking member 86 operate to move engagement member 87 into recess 90 and thereby locking the side charger 46 in a forward position and maintaining the side charge 46 in the forward position during firing and other operation of the firearm. This is particularly helpful in AR Style rifles and/or rifles with larger rounds or that have larger recoil.

Accordingly, the components defining any upper receiver assembly may be formed of any of many different types of materials or combinations thereof that can readily be formed into shaped objects provided that the components selected are consistent with the intended operation of a upper receiver assembly. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any upper receiver assembly may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. An upper receiver assembly with a side charger for an AR rifle, comprising:

a charging handle that extends through a channel of an upper receiver body, the channel extending along a lateral side of the upper receiver body;

a bolt carrier engagement member, wherein the bolt carrier engagement member engages the bolt carrier and moves the bolt carrier in response to pulling the charging handle toward the butt stock of the rifle; and a locking device coupled to the charging handle for releasably locking the side charger in a forward position during firing and other operation of the firearm, wherein a locking member of the locking device is received into a recess in a lateral side of the bolt carrier while in a locked position.

2. An AR rifle comprising:

a lower receiver;

a butt stock coupled to the lower receiver;

a trigger operatively coupled within the lower receiver;

a magazine removably coupled to the lower receiver for holding ammunition; and an upper receiver assembly coupled to the lower receiver and a barrel, wherein the upper receiver assembly comprises:

an upper receiver body with a channel formed in a lateral side of the body;

a bolt carrier operatively coupled within the upper receiver body;

a bolt coupled within the bolt carrier; and a side charger comprising:

a charging handle that extends through the channel of the upper receiver body;

a bolt carrier engagement member, wherein the bolt carrier engagement member engages the bolt carrier and moves the bolt carrier in response to pulling the charging handle toward the butt stock of the rifle; and a locking device coupled to the charging handle for releasably locking the side charger in a forward position during firing and other operation of the firearm, wherein a locking member of the locking device is received into a recess of a lateral side of the bolt carrier while in a locked position.

3. An upper receiver assembly with a side charger of a rifle comprising:

a charging handle that extends through a channel of an upper receiver body, the channel extending along a lateral side of an upper receiver body;

a bolt carrier engagement member, wherein the bolt carrier engagement member engages a bolt carrier and moves the bolt carrier in response to pulling the charging handle toward the butt stock of the rifle; and a locking device for releasably locking the side charger in a forward position during firing and other operation of the firearm, wherein the locking device comprises:

a rotatable actuating device comprising a hook member; and a rotatable locking member comprising a hook member and an engagement member, wherein the rotation of the rotatable actuating device rotates the rotatable locking member to move the engagement member of the rotatable locking member out of and into a recess of a lateral side of the bolt carrier.

* * * * *